United States Patent [19]

Stölzle et al.

[11] 4,221,401

[45] Sep. 9, 1980

[54] CROSS-COUNTRY-SKI BINDING WITH AUTOMATIC LOCKING

[76] Inventors: Fritz Stölzle, Johann Clanze-Strasse 91, 8 München 70; Heinrich Cmiel, Preziosa-Strasse 51, 8 München 81, both of Fed. Rep. of Germany

[21] Appl. No.: 958,335

[22] Filed: Nov. 7, 1978

[51] Int. Cl.[3] ..... A63C 9/00

[52] U.S. Cl. ..... 280/615; 280/611

[58] Field of Search ..... 280/614, 615, 611

[56] References Cited

U.S. PATENT DOCUMENTS

| | | | |
|---|---|---|---|
| 3,861,700 | 1/1975 | Fredriksen | 280/615 |
| 3,979,131 | 9/1976 | Ginther | 280/615 |
| 4,102,063 | 7/1978 | Ihlen | 280/615 X |

FOREIGN PATENT DOCUMENTS

| | | | |
|---|---|---|---|
| 2360674 | 6/1974 | Fed. Rep. of Germany . | |
| 61821 | 2/1924 | Sweden | 280/615 |

*Primary Examiner*—John J. Love
*Assistant Examiner*—D. W. Underwood
*Attorney, Agent, or Firm*—Fleit & Jacobson

[57] ABSTRACT

In a cross-country or langlauf-ski binding having a sole plate, locking pins engageable with the sole of a ski boot and a clip locating the sole on the locking pins, there is provided a mechanism, enabling an easy and comfortable manipulation of the binding. For this purpose the sole plate comprises lateral mounting flanges with coaxial bearing holes and holding elements. These parts are cooperating in such a manner that they come into engagement during the insertion of the ski boot of a skier being automatically locked in this operative position. For releasing the binding the skier has only to press down a suitable release mechanism.

4 Claims, 3 Drawing Figures

III
1
2
3
4
5
6
7
8
9
10
12
13
15
16
17
S

CROSS-COUNTRY-SKI BINDING WITH AUTOMATIC LOCKING

The invention relates to a cross-country ski binding having a sole plate securable to the ski, locking pins projecting upwardly from the sole plate for engaging the front margin of the sole of the ski boot and a clip fixing the margin of the sole of the locking pins.

BACKGROUND OF THE INVENTION

In ski bindings of the kind referred to, the skier must press the locking pins into the respective grooves being provided at the front margin of the sole of the boots. Following the skier must apply a clip effecting the upper edge of the sole of the ski boot and locking the locking pins in the grooves respectively. For applying the cross-country ski the skier therefore must not only bend down, but a certain skill is necessary to center the locking pins with respect to the corresponding grooves in the sole and to apply the blocking clip. As soon as the skier wants to open or to release the binding, he must bent down again and has to shift the clip from the margin of the ski boot away.

SUMMARY OF THE INVENTION

Therefore the primary object of the present invention is to provide a cross-country ski binding of the kind referred to above which permits an easy and comfortable manipulation by applying the cross-country skis.

In accordance with the present invention, a cross-country ski binding comprising lateral mounting flanges provided on the sole plate and having coaxial bearing holes and holding elements which engage the upper face of the margin of the sole, a holding plate carrying the pins which is pivotally connected to the sole plate beneath the same, apertures provided on the sole plate and enabling the pins to pass therethrough, and locking means provided on the front part of the holding plate for connection to the sole plate. For connecting the ski boot to the cross-country ski binding in accordance with the invention, the skier has only to place his ski boot on the sole plate in such a manner that the holding elements come into engagement with the upper face of the sole. The skier then has to press down the front part of the sole plate using the tip of the ski boots, and the locking pins enter into the grooves in the sole passing through the sole plate. In this condition the locking elements lock the holding plate together with the sole plate. Practically the locking elements include a hook having an inclined lug which slides along the front edge of the sole plate, whereby the hook may resiliently snap in its closed condition. For releasing the binding it is thus only necessary to push the hook backwards past the front edge using the ski stick, so that the holding plate carrying the locking pins may pivot away. For this purpose the hook may be provided with special projections or recesses serving as an easier engaging means for the ski stick.

The foregoing and other objects, features and advantages of the invention will be apparent from the following description of a preferred embodiment of the invention as illustrated in the accompanying drawings.

DRAWINGS

In the drawings:

FIG. 1 is a side elevation of a cross-country ski binding according to the invention in its open or released condition, FIG. 2 is a side elevation of the cross-country ski binding in its closed or locked condition; and FIG. 3 is a plan view of the cross-country ski binding as shown in FIGS. 1 and 2.

DETAILED DESCRIPTION OF THE PREFERRED EMBODIMENT

Figure 1:
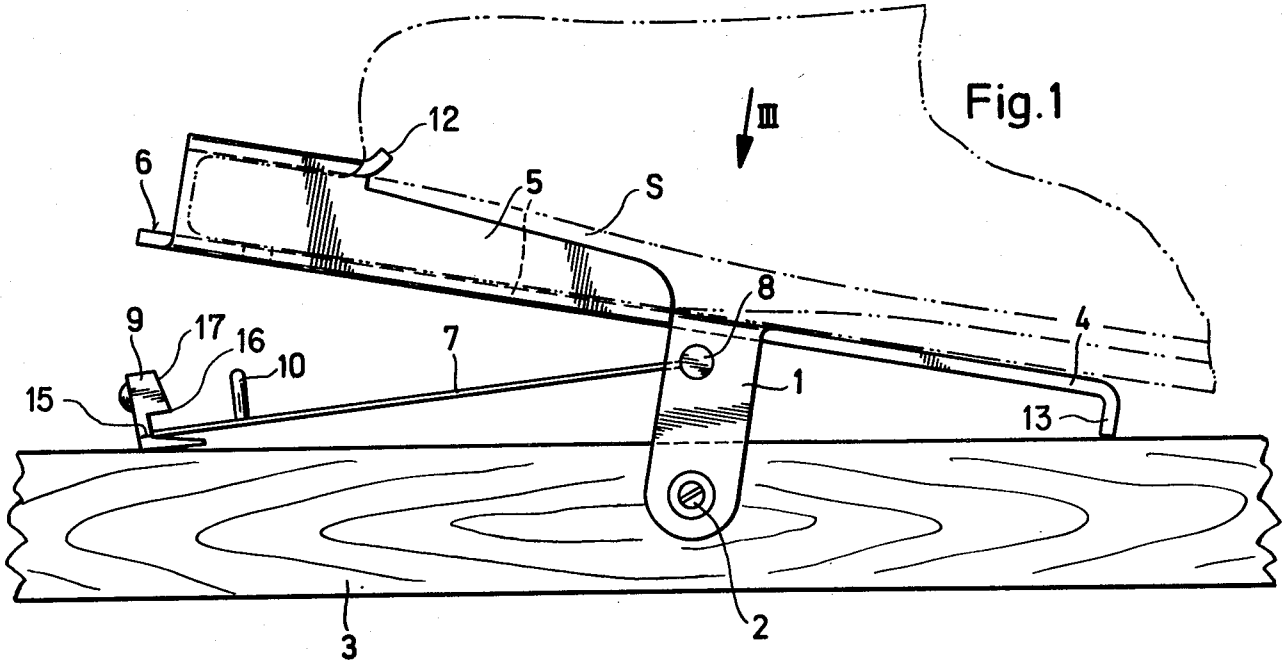
Figure 2:
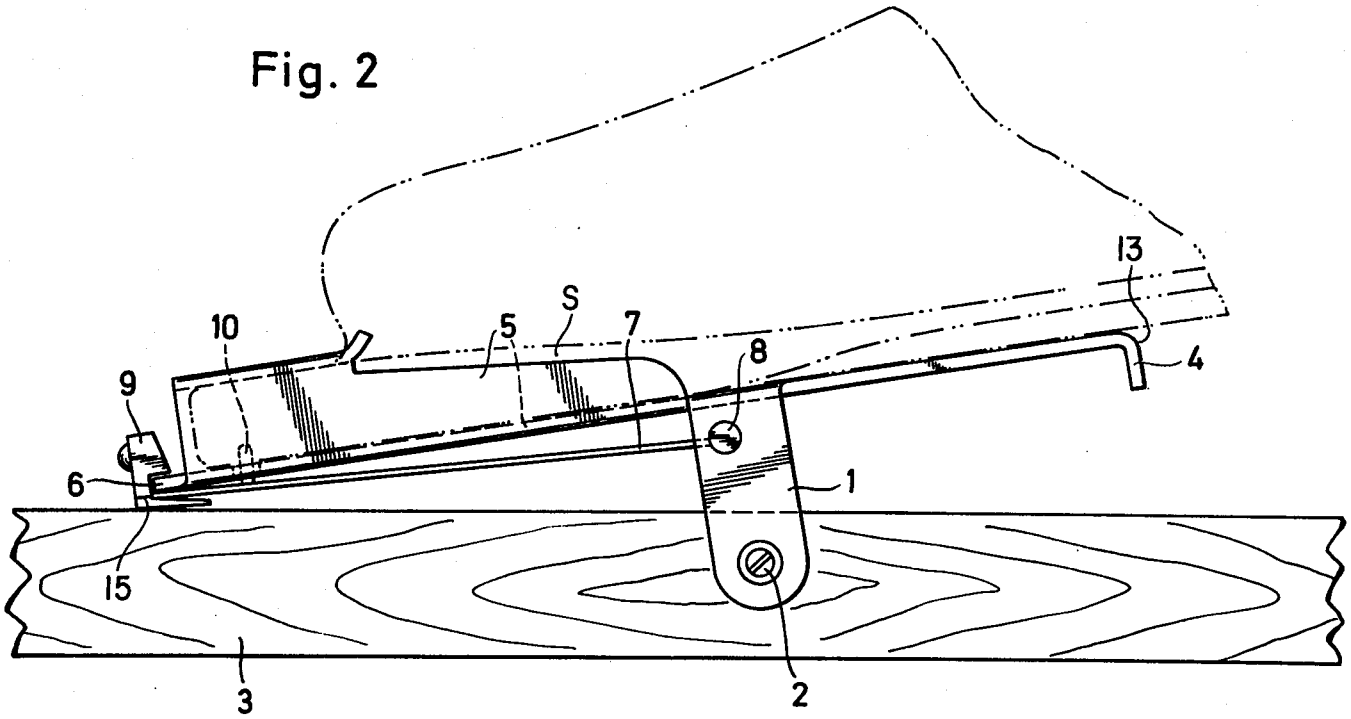
Figure 3:
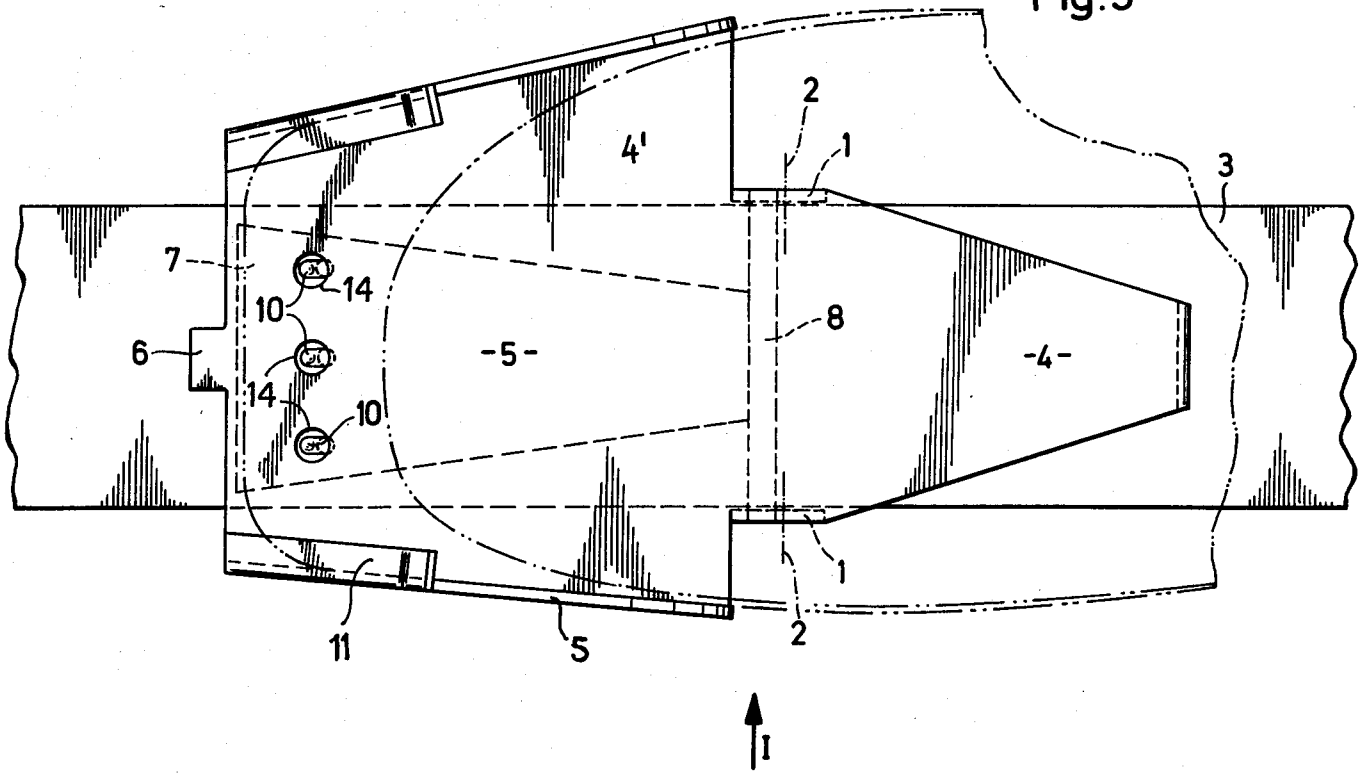

Referring to the drawings, especially to FIGS. 1 and 2, the cross-country ski binding comprises a sole plate 4 having laterally bended mounting flanges 1 which enclose the cross-country ski 3. The mounting flanges 1 are provided in their downwardly extending sections with bores being in alinement with one another. In these bores there are disposed bearing pins which were screwed in the side of the cross-country ski 3. The mounting flanges 1 are so designed and have such a longitudinal extension that the sole plate 4 is pivotally journalled on the cross-country ski 3 and can pivot about the bearing pins 2 as a see-saw.

The sole plate 4 has an enlarged front part 4' which is defined by upwardly bended side portions 5 serving as a guidance for the sole S of the inserted ski boot. Holding elements 11 bended in form of a hook are provided by the perpendicularly upstanding side portions 5. These holding elements 11 cover the sole of the ski boot from above and coming into engagement with the upper face of the sole. The leading ends of the holding elements 11 are provided with an upwardly extending bend portion 12 which facilitates the insertion of the sole of the ski boot. Although not shown, these side portions 5 are adaptable to the respective width of the sole of the ski boot in a manner as known per se. For this purpose the side portions 5 could be secured to the holding jaws which are movably guided in elongated holes. The rearward part of the sole plate which is diminished in its diameter, is a bended portion 13 on its end which may support the sole plate 4 on the cross-country ski 3.

A pin 8 is mounted on the mounting flanges 1 tightly beneath the sole plate 4 and extends parallel to the bearing pins 2. The pin 8 passes through a curled portion or an ear-like element of the holding plate 7 so that the holding plate 7 is pivotally provided around the pin 8. On its front portion, the holding plate 7 carried three arresting or locking pins 10 which pass through apertures 14 in the sole plate, resp., when the holding plate 7 is pivoted against the sole plate 4.

The front end of the holding plate 7 is connected to the hook 9 by means of rivets 15. The hook 9 has a lug 16 being provided above the holding plate 7 in spaced relationship thereto. The spacing between 16 and the holding plate 7 is slightly larger than the thickness of the front edge 6 of the sole plate 4. The lug 16 is further provided with a ramp surface 17 against which the front edge 6 of the sole plate 4 will abut when its front edge would be pressed down towards the holding plate 7. When the front part 4' of the sole plate 4 is pressed down by the inserted ski boot, the front edge 6 will abut the ramp surface 17, and the hook 9 will be pushed outwards due to the elasticity of the holding plate 7 until the lug 16 clicks. Then the ski boot is so connected to the sole plate 4 that the locking pins 10 have entered the respective grooves in the sole of the ski boot passing through apertures 14. The locking pins 10 are preventing any removal of the sole plate 4 in a horizontal direction whereas a removal of the sole of the ski boots in a vertical direction is additionally prevented by the holding elements 11.

Instead of a special hook 9 connected to the resilient or elastic holding plate 7, the holding plate 7 can hook-like be bended. Advantageously a bended portion is provided thereby which can be operated by the ski stick in a simple manner in case the binding has to be released. The length of the mounting flanges 1 is at least so long that the locking pins are completely retracted out of the apertures 14 when the sole plate 4 has been pivoted in its rearward position.

While the invention has been particularly shown and described with reference to a preferred emobodiment, it will be understood by those skilled in the art that various changes in form and detail may be made without departing from the spirit and scope of the invention.

What is claimed is:

1. A cross-country ski binding having a sole plate securable to the ski, locking pins projecting upwardly from the sole plate for engaging the front margin of the sole of a ski boot, and a means for fixing the sole margin on the locking pins comprising: lateral mounting flanges (1) provided on the sole plate (4) and having downwardly bent side portions positionable on opposite side edges of a ski, said side portions having coaxial bearing holes formed therein for receiving a bearing pin connecting said mounting flanges to the ski, said means for fixing including holding elements which come into engagement with the upper face of the margin of the sole, a holding plate (7) carrying said locking pins (10) which is pivotally connected to said sole plate beneath the same, apertures (14) provided in the sole plate and enabling said pins to pass therethrough, and locking means (9) provided on the front part of the holding plate (7) for connection with the sole plate (4).

2. Cross-country ski binding according to claim 1, whereby said holding plate (7) is pivotably about pivot pins (8) connected with the sole plate (4).

3. Cross-country ski binding according to claim 1, whereby the said locking means comprise a resiliant clip (9) engaging the upper part of the front edge (6) of the sole plate (4).

4. Binding for a cross-country ski comprising a holding plate which supports retention pins for engaging the under-side of the sole of a ski boot, a sole plate supported by the ski, which has, within the area of its end facing the point of the ski, at least one holding device for the upper edge of the sole of the boot, and, on each side, a mounting flange that extends downwardly towards the running surface of the ski and, on one lateral surface of the ski, pivots around an axis that is common to both flanges and runs in a direction that is transverse to the longitudinal direction of the ski as well as parallel to the upper surface of the ski, said axis having been provided in that area of the sole of the boot that is located between a transverse plane passing through the retention pins and another transverse plane passing through the rear end of the sole plate, and means for locking said sole plate on the holding plate, within the area of its front-end, said holding plate being provided between the upper surface of the ski and said sole plate and being supported by said sole plate, said sole plate having openings for passage of the retention pins, said locking means including a hook member mounted on the front end of said holding plate.

* * * * *